United States Patent [19]

deVos et al.

[11] 4,319,312

[45] Mar. 9, 1982

[54] LUMINAIRE

[75] Inventors: Hendrick A. J. deVos; Elzear R. Labouliere, both of Swansea, Mass.

[73] Assignee: GTE Products Corporation, Stamford, Conn.

[21] Appl. No.: 204,105

[22] Filed: Nov. 5, 1980

Related U.S. Application Data

[63] Continuation of Ser. No. 25,258, Mar. 29, 1979, abandoned.

[51] Int. Cl.[3] ..... F21V 13/06

[52] U.S. Cl. ..... 362/282; 362/300; 362/301; 362/310; 362/368; 362/375; 362/431

[58] Field of Search ..... 362/282, 300–302, 362/304, 305, 310, 346, 370, 374, 362, 375, 431, 368

[56] References Cited

U.S. PATENT DOCUMENTS

| | | | |
|---|---|---|---|
| 1,631,112 | 6/1927 | Aalborg | 362/375 |
| 1,713,335 | 5/1929 | Greene | 362/297 |
| 1,955,947 | 4/1934 | Clark | 362/812 |
| 2,913,570 | 11/1959 | Gough et al. | 362/348 |
| 3,019,333 | 1/1962 | Pascucci | 362/374 |
| 3,096,030 | 7/1963 | Harling | 362/297 |
| 3,162,373 | 12/1964 | Biggs et al. | 362/297 |
| 3,267,276 | 8/1966 | Hasler | 362/294 |
| 3,755,665 | 8/1973 | Grindle | 362/374 |
| 4,173,037 | 10/1979 | Henderson, Jr. et al. | 362/431 X |
| 4,173,778 | 11/1979 | Snavely et al. | 362/297 |

FOREIGN PATENT DOCUMENTS

| | | | |
|---|---|---|---|
| 933854 | 5/1948 | France | 362/297 |
| 307722 | 3/1929 | United Kingdom | 362/297 |

*Primary Examiner*—Peter A. Nelson
*Attorney, Agent, or Firm*—Lawrence R. Fraley

[57] ABSTRACT

A pole-mounted, direct luminaire for providing a square, Type V pattern of light distribution. Ready access to the luminaire's internal components (e.g. reflector, transformer, capacitor) is assured by utilization of a spring-loaded, easily removable top cover. The cover includes a reflective surface thereon which aligns with an aperture located in the apex portion of the luminaire's reflector component when the cover is in the closed position.

9 Claims, 5 Drawing Figures

LUMINAIRE

This is a continuation, of application Ser. No. 25,258, filed Mar. 29, 1979, and now abandoned.

CROSS REFERENCE TO RELATED APPLICATIONS

An application under Ser. No. 025,256 was filed Mar. 29, 1979 and assigned to the assignee of the instant invention. Ser. No. 025,256, entitled "Luminaire" (Inventors: E. R. Labouliere et al) is a design application for a luminaire.

Another application, Ser. No. 025,257, was also filed Mar. 29, 1979 and assigned to the assignee of the present invention. Now U.S. Pat. No. 4,242,727, is entitled "Luminaire Reflector" (Inventors: H. A. J. deVos et al) and defines a multifaceted reflector capable of being utilized in the present invention.

BACKGROUND OF THE INVENTION

The present invention relates to luminaires and particularly to enclosed luminaires concerned with illuminating public areas such as parking lots, malls, parks, walkways, etc.

Even more particularly, the invention relates to luminaires of the above variety which are capable of providing direct lighting to these areas.

Luminaires of the type described are typically mounted on poles or similar supportive structures at elevations usually ranging from twenty to fifty feet. Accordingly, it is understood that a highly desirous feature of such devices is that maintenance thereof should be capable of accomplishment in a safe and expeditious manner. Heretofore, servicing of most prior art luminaires involved releasing and lowering a pivotal bottom portion of the device and thereafter reaching upwardly to repair or replace the defective component. An example of such a luminaire is shown in U.S. Pat. No. 4,028,541. In addition to the generally awkward situation created by the aforedescribed requirements, luminaires such as shown in U.S. Pat. No. 4,028,541 proved relatively costly to produce due to the need for elaborate pivot and latch mechanisms required to provide the described release and retention of the luminaire's bottom portion during periods of repair and operation, respectively. It was also possible for such retention mechanisms to fail, particularly during periods of high wind turbulence about the luminaire.

It is believed, therefore, that a luminaire for use in an outdoor environment which is relatively inexpensive to produce compared to prior art devices and which is capable of being serviced in a relatively safe and expeditious manner would constitute a significant advancement in the art.

OBJECTS AND SUMMARY OF THE INVENTION

It is therefore a primary object of the present invention to provide a luminaire of the above type which permits ready, safe access to the internal components thereof during periods of servicing the luminaire.

It is another object of the invention to provide a luminaire which is economically produced and assures ease of assembly.

It is a further object of this invention to provide a luminaire of this variety which is capable of providing direct illumination on a designated area therebelow while the luminaire is substantially horizontally aligned.

Yet another object of the invention is to provide a luminaire of the above type wherein the pattern of illumination on said designated area is substantially square, thus enhancing the luminaire'use in combination with other, similar devices.

Still another object of the invention is to provide a direct luminaire wherein the internal components thereof are easily removable for repair or replacement.

In accordance with one aspect of the invention, there is provided a luminaire which comprises a housing including a plurality of side walls, and upper and lower openings therein. Within the housing is a concave reflector which directs light from the luminaire's light source toward the housing's lower opening. A light-transmitting member occupies the lower opening to permit passage of the directed light therethrough. A cover is secured to one of the housing's side walls and is used to cover the luminaire's upper opening during operation thereof and to permit ready access to the interior of the luminaire during servicing.

DETAILED DESCRIPTION OF THE PREFERRED EMBODIMENTS

For a better understanding of the present invention together with other and further objects, advantages and capabilities thereof, reference is made to the following disclosure and appended claims in connection with the above-described drawings.

Figure 1:
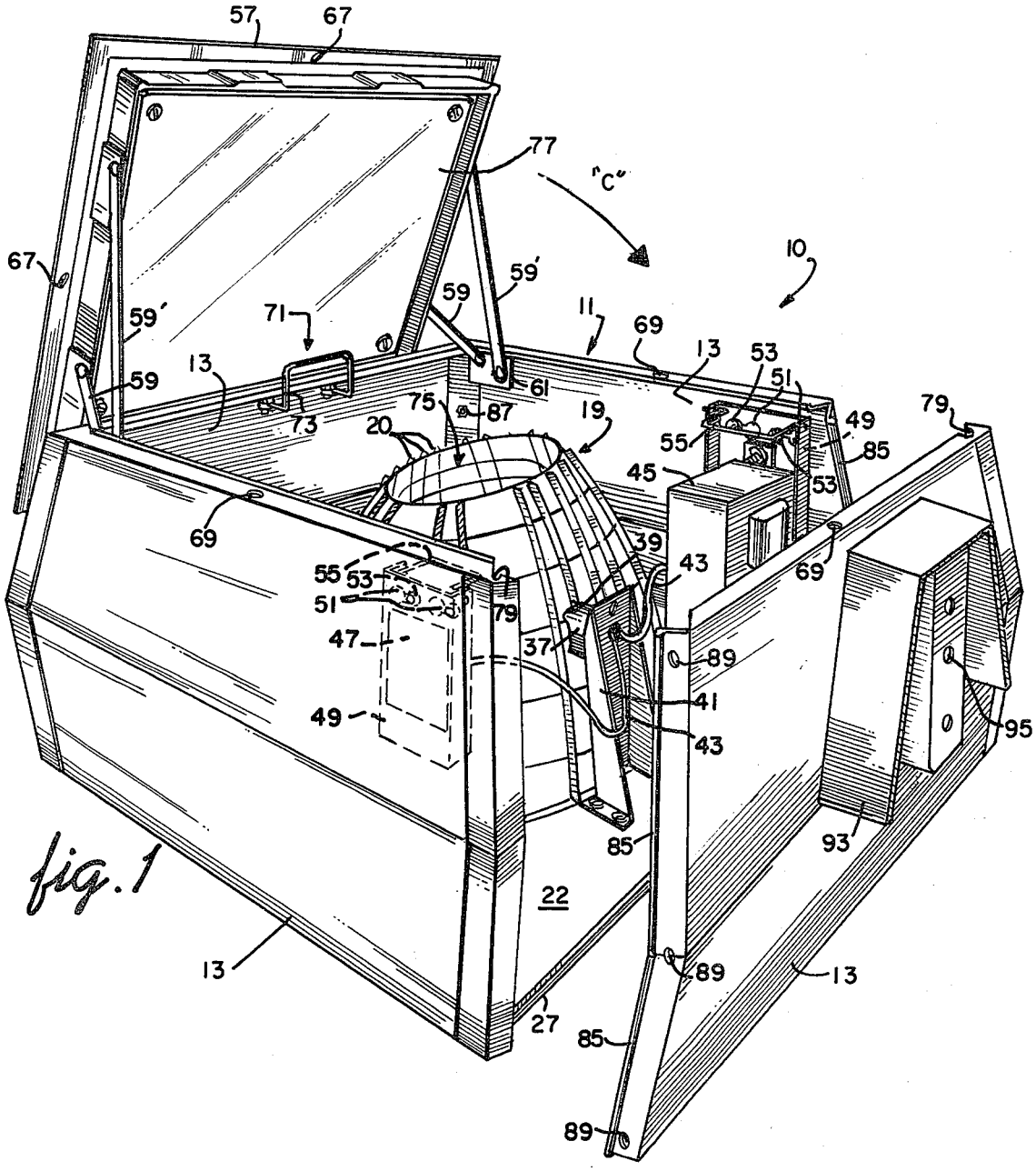
FIG. 1 is a perspective view of a luminaire in accordance with a preferred embodiment of the invention, said luminaire having one side partially removed and the top cover in the open position.

With particular regard to FIG. 1, there is shown a luminaire 10 which is designed for providing direct illumination on a planar area located therebelow when the luminaire is oriented in a horizontal manner. By direct illumination is meant that from about ninety to one-hundred percent of the luminaire's light out-put is directed downward during operation. As will be defined, the pattern of illumination produced by luminaire 10 is substantially square in configuration when directed upon a planar area below the luminaire. As will be further defined, this pattern is in the form of a type V distribution; that is, luminaire irradiates in a substantially uniform manner to all locations in the square pattern, including the diagonals thereof. One example of the aforedefined distribution is shown in the copending application under Ser. No. 025,257.

Luminaire 10 comprises a rectangular housing 11 which includes four upstanding side walls 13. One of walls 13 is partially removed from housing 11 in FIG. 1 for clarification purposes. An important feature of luminaire 10 is that walls 13 are similar in configuration, thus significantly reducing known manufacturing costs and also assuring ease of assembly of the instant invention. Typical prior art luminaires have heretofore included housings formed as a single piece casting, or by means of welded extrusions. Still another costly technique involved forming and welding sections of sheet metal. The present invention eliminates the above need for complex molds, welding, etc. in that the four side walls 13, preferably aluminum, may be cast from a single mold and thereafter assembled with relative ease (in a manner to be described below).

Figure 2:
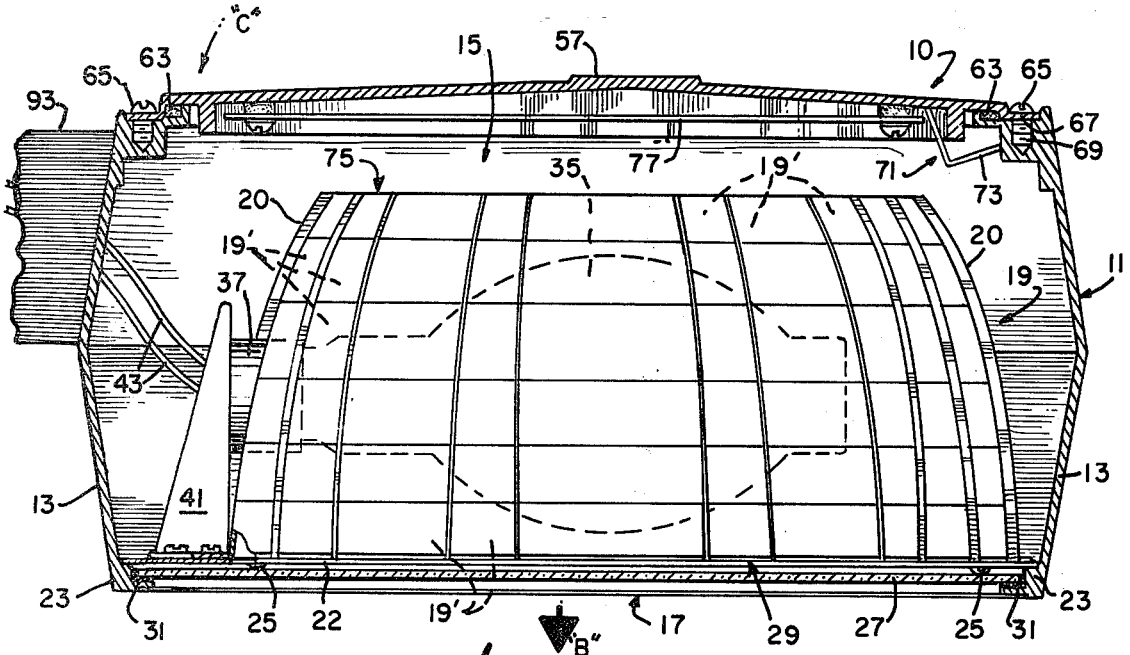
FIG. 2 is a side elevational view, in section, of the luminaire of FIG. 1 with the top cover in the closed position.

When fully assembled (FIG. 2), housing 11 defines upper and lower openings 15 and 17, respectively. It is understood that these openings assume the defined positioning relationship within housing 11 when luminaire 10 is oriented in a horizontal operating position, as shown in FIG. 2.

Located within housing 11 is a concave reflector 19 which is secured (e.g. by screws) to a base plate 22 which in turn is secured (e.g. also by screws) to at least one, and preferably all, of the projecting base portions 23 of side walls 13. It is understood that reflector 19 could be directly attached to portions 23, thus excluding the need for plate 22. The illustrated arrangement is preferred, however, for ease of assembly and to promote rigidity of the reflector. Base plate 22 includes an opening therein which aligns with the forward, emitting end of reflector 19. Plate 22 also includes a plurality of extending members ("bumps") 25 about the periphery thereof which assure an appropriate spacing between the reflector and a substantially planar light-transmitting member 27 located within lower opening 17 and serving as a closure therefor. Member 27 may be clear, diffused, or prismatic. A gasket 31 is used to seal member 27 within opening 17.

Reflector 19 is preferably specular reflective; that is, the angle between the reflected pencil (or ray) of light and a normal to the surface of the reflector will equal the angle between the incident pencil (or ray) and said normal. Examples of suitable specular reflective materials for reflector 19 include polished and electrolytically formed anodic oxide on aluminum, and first-surface silvered glass or plastic mirrors. As shown in FIG. 2, reflector 19 is comprised of several, individual planar reflecting segments 19' which assure the aforedescribed square pattern of light on the area below (direction "B") luminaire 10. Reflector 19 also includes a plurality of reinforcement ribs 20 which are formed as extensions of segments 19' and bonded together during assembly of the reflector.

The preferred light source 35 for luminaire 10 is a high intensity discharge (HID) lamp, such lamps well known in the industry for possessing high efficacy, long life, and good lumen maintenance. Additionally, HID lamps each provide a compact light source which permits effective light control by a reflector component when positioned therein. The three principal HID lamps currently in use are mercury, high pressure sodium, and metal halide. Examples of HID lamps suitable for use in luminaire 11 are described in U.S. Pat. Nos. 3,714,485 (C. L. Peterson et al), 4,037,129 (A. T. Zack et al), and 4,053,805 (J. A. Scholz et al), all of which are assigned to the assignee of the instant invention. Lamp 35 is also shown in FIG. 2 as being horizontally disposed within housing 11. Lamp 35 is located within a socket 37 which projects through a relatively small opening 39 within the side of reflector 19. Socket 37 is secured to an upright support 41 which in turn includes an orifice therein through which the respective electrical wiring 43 may pass. Wiring 43 connects socket 37 to the electrical ballast components of the invention located within housing 11. These components serve to operate lamp 35 when luminaire 10 is electrically connected to a suitable, external line source, and include a transformer 45 and capacitor 47. Examples of both of these components are well known in the art and further description is not believed necessary. Further description is also not believed necessary for the circuit arrangement which includes these components and socket 37 because such an arrangement is well within the capabilities of one skilled in the art. Of particular significance, however, is the manner in which transformer 45 and capacitor 47 are oriented within housing 11. Each of these components is located on a respective tray member 49 which in turn is attached on opposing, facing side walls 13 in order to assure maximum spacing between the ballast components. This separation is deemed important to make luminaire 10 less sensitive to critical temperatures. That is any excessive heat generated by one component will be adequately removed by the heat conductive side walls 13 to the luminaire's external environment rather than adversely affect the remaining component.

Trays 49 are especially designed for rapid removal from housing 11 (through upper opening 15). Each includes a pair of spaced keyholes 51 which each accommodate a retention bolt 53. After completing electrical disconnection, a person servicing luminaire 10 has only to loosen bolts 53, slightly move tray 49 to one side, and thereafter effect removal. Each tray is also provided with a handle 55 to facilitate this procedure.

Luminaire 10 further includes a top cover 57 which is secured to at least one side wall 13 and occupies first (closed) and second (open) positions with respect to housing 11. Cover 57 is shown in the closed position in FIG. 2 and in the fully open position in FIG. 1. The direction of closure ("C") is illustrated in both FIGS. 1 and 2. With particular regard to FIG. 1, cover 57 is hinged on opposing sides thereof to two facing side walls. Each hinge assembly includes a pair of different length arms 59 and 59' (arm 59' being the longer), each of which is secured at one end to cover 57 and at the other to a flange 61 (only one shown) which forms an extension of one of the walls 13. Arms 59' are connected to flange 61 at a lower elevation than arms 59 to assure that cover 57 will assume a position parallel to the upper surface of housing 11 immediately prior to final closure. This prevents possible bending (or bowing) of cover 57, thereby assuring an effective seal between the cover and upper surfaces of walls 13. A gasket 63 is provided atop each wall to further assure the aforedescribed seal. Cover 57 is retained in the closed position by four quick-release screws 65. Cover 57 is provided with four holes 67 (two shown in FIG. 1) and each wall 13 is provided with a singular hold 69 to accommodate screws 65. The defined openings are preferably located at the approximate center of the respective part.

Release of cover 57 is facilitated by provision of a biasing means 71 which continuously biases the cover toward the open position. Means 71 comprises a spring 73 secured (via screws) to the upstanding side wall between the walls accommodating the cover's hinge assemblies. Spring 73, being pre-stressed, maintains engagement with an internal surface of cover 57 and exerts its greatest force when the cover is fully closed and sealed. Accordingly, when the person servicing luminaire 10 releases screws 65, the cover will rapidly open to the aforedefined parallel position. At this position, the cover is approximately 0.500 inch from the upper edges of walls 13 such that it can be readily grasped and further removed to the fully open position.

As understood from the foregoing, luminaire 10 readily lends itself to servicing during periods of needed replacement and repair. To even further promote this aspect of the invention, reflector 19 includes an aperture 75 within the apex portion thereof such that a person desiring to replace lamp 35 may do so by merely reaching through aperture 75 and thereafter unscrewing and removing the lamp. To accommodate for the loss of reflective surfaces taken by the provision of aperture 75, top cover 57 is provided with a substantially planar reflective surface 77 which aligns with reflector 19 in the manner shown in FIG. 2. Surface 77 is preferably diffusively reflective; that is, the material for surface 77 is roughened or is composed of minute crystals or pigment particles. Accordingly, each ray of incident light obeys the law of reflection but because the surface of the particles are at different planes, the light is reflected at many angles. Understandably, this light is also directed toward lower opening 17 of reflector 19. Suitable materials for the diffusely reflective surface 77 include flat paints and other matte finishes. Surface 77 may also be diffuse-specular wherein from about 5 to 15 percent of the incident light is directionally controlled. Examples of this material include porcelain enamel, glossy synthetic finishes, and other surfaces with a shiny, transparent finish over a matte base.

Figure 3:
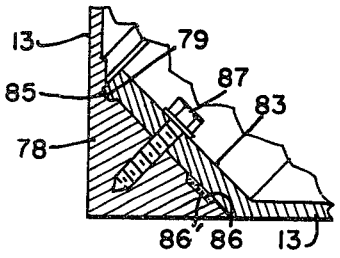
FIG. 3 is a partial plan view, in section, illustrating the mating relationship between two of the upstanding side walls of the invention.

The partial view in FIG. 3 represents the interlocking relationship between two adjacent side walls 13 of housing 11. One end of each wall includes a substantially solid, triangular-shaped portion 78 having an elongated groove or slot 79 therein. The opposing end walls 13 each include an angular flange portion 83 having an elongated rib 85 thereon. As shown in FIG. 3, rib 85 aligns within groove 79 to interlock the respective walls 13. A seal is assured between walls 13 in FIG. 3 by provision of a second groove 86 within triangular portion 78, said groove including a plastic seal material 86' (e.g. Silicone) therein. Three screws 87 (one shown in FIG. 3) are used to achieve final securing of these parts. Three openings 89 are provided in each flange 83 to accommodate screws 87. It is thus seen that separation of each wall 13 from the remaining walls of housing 11 is initially accomplished from within the confines of the housing itself.

Figure 4:
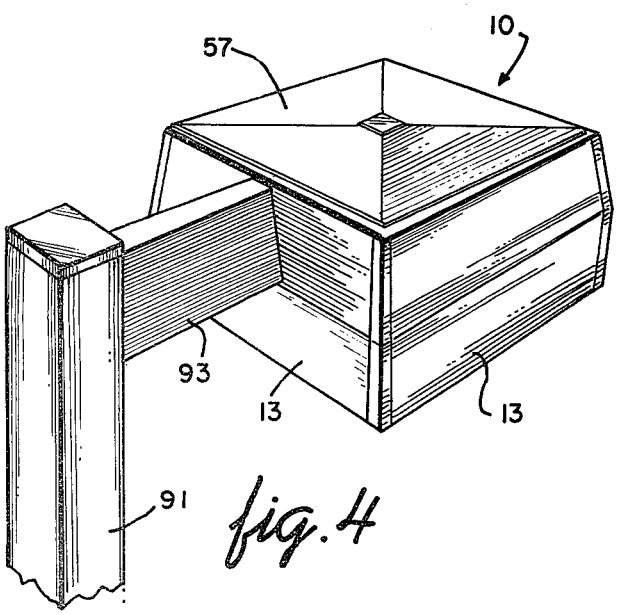
FIGS. 4 and 5 are perspective views of the present invention, as assembled, including various means for mounting the invention on a pole or similar supportive structure.
Figure 5:
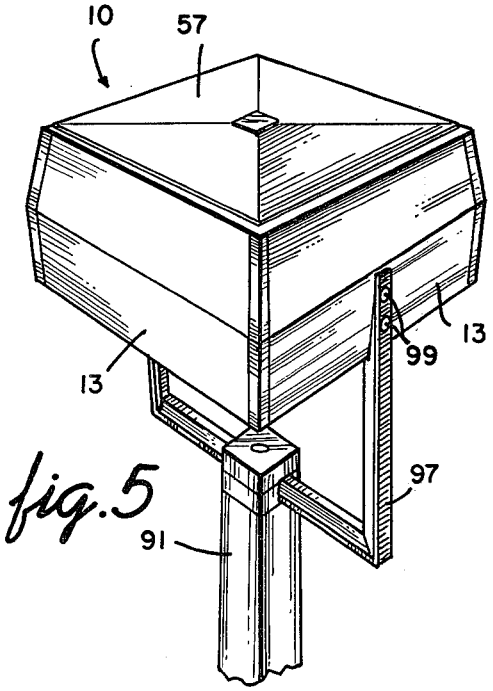

In FIGS. 4 and 5, there are shown two different embodiments of means for mounting luminaire 10 on a pole 91 or similar supportive structure. In FIG. 4, a mounting arm 93 (see also FIG. 1) is secured to one of the walls 13 and includes at least one opening 95 therethrough in which the required wiring (not shown) for interconnecting luminaire 10 to an external line source may be located. Arm 93 may be attached to wall 13 and pole 91 by bolts. In FIG. 5, a U-shaped yoke 97 is used to secure luminaire 10 atop a pole 91. Yoke 97 is secured to opposing side walls 13 by bolts 99 (only two shown).

There has thus been shown and described a direct luminaire which readily lends itself to servicing by provision of a top cover hingedly secured to the luminaire's housing for permitting access to the interior thereof when open. Accordingly, service may be accomplished from the top down rather than from the bottom up, thus facilitating this procedure. Service is even further enhanced by spacedly positioning the luminaire's ballast components on readily removable trays and by providing an aperture within the apex portion of the luminaire's reflector to permit rapid removal of the light source therefrom. As described, the instant invention provides a substantially square pattern of light distribution on a surface located below the invention. This feature represents a significant advantage over luminaires which provide round or oval light patterns, particularly when the invention is utilized in combination with other, similar components, by substantially eliminating much of the excessive overlapping of illumination required in arrangements of round or oval pattern devices. Accordingly, fewer luminaires of the present invention can be employed to adequately illuminate the same area covered by the aforedescribed round or oval devices.

While there have been shown and described what are at present considered the preferred embodiments of the invention, it will be obvious to those skilled in the art that various changes and modifications may be made therein without departing from the scope of the invention as defined by the appended claims.

What is claimed is:

1. A direct luminaire comprising:

a housing including a plurality of upstanding side walls, and spaced-apart upper and lower openings therein;

a substantially horizontally disposed light source located within said housing;

a substantially concave, specularly reflective reflector located within said housing for reflecting the light emitted from said light source toward said lower opening of said housing, said light source positioned within said reflector, said reflector including an aperture within the apex portion thereof to permit removal of said light source therethrough, said aperture located adjacent said upper opening of said housing;

a light-transmitting member positioned within said lower opening of said housing for having said light from said light source pass therethrough; and a removable top cover member secured to at least one of said upstanding side walls of said housing for occupying first and second positions with respect thereto, said cover member providing a closure for said upper opening when said cover occupies said first position and permitting access to the interior of said housing and said removal of said light source through said aperture within said reflector when said cover occupies said second position, said cover member including a substantially diffusively reflective surface thereon located adjacent said aperture within said reflector for reflecting light from said light source toward said lower opening of said housing, said luminaire providing a substantially square pattern of illumination on a planar area located below said luminaire when said luminaire is located in a horizontal position.

2. The luminaire according to claim 1 wherein said cover member is hingedly mounted on two opposing side walls of said housing, said mounting provided by a pair of hinge assemblies each secured to a respective one of said opposing side walls.

3. The luminaire according to claim 2 wherein each of said hinge assemblies includes a pair of different length arm members to assure that said cover member will assume a position parallel to the upper surface of said housing immediately prior to said cover providing said closure.

4. The luminaire according to claim 2 further including means for biasing said cover toward said second position, said biasing means comprising a pre-stressed spring secured to one of said upstanding side walls interconnecting said two opposing side walls having said cover member hingedly mounted thereon and in contact with said cover member during said first position.

5. The luminaire according to claim 1 wherein the number of said upstanding side walls is four, each of said side walls similar in configuration and separable from the remainder of said housing.

6. The luminaire according to claim 5 further including means for interlocking adjacent pairs of said side walls along end portions thereof, each of said side walls including an elongated rib along an end thereof and an elongated groove along an opposing end thereof, each of said ribs aligning within a corresponding one of said grooves located within an adjacent one of said side walls to provide said interlocking between said adjacent side walls.

7. The luminaire according to claim 1 wherein said substantially planar reflective surface located on said top cover member is located above said horizontally disposed light source when said luminaire is horizontally aligned.

8. The luminaire according to claim 1 wherein said horizontally disposed light source is a high intensity discharge lamp, said lamp extending through an opening provided within a side of said concave reflector.

9. The luminaire according to claim 1 further including light source ballast components located within said housing, each of said components attached to a tray member which is readily removable from within said housing through said upper opening when said cover member occupies said second position.

* * * * *